US006304131B1

(12) United States Patent
Huggins et al.

(10) Patent No.: US 6,304,131 B1
(45) Date of Patent: Oct. 16, 2001

(54) HIGH POWER SUPPLY RIPPLE REJECTION INTERNALLY COMPENSATED LOW DROP-OUT VOLTAGE REGULATOR USING PMOS PASS DEVICE

(75) Inventors: Mark Wayne Huggins, Rowlett; Gabriel Alfonso Rincon-Mora, Allen, both of TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/510,083

(22) Filed: Feb. 22, 2000

(51) Int. Cl.[7] ..... G05F 1/10
(52) U.S. Cl. ..... 327/538; 327/382
(58) Field of Search ..... 327/382, 538, 327/540, 541, 542, 543

(56) References Cited

U.S. PATENT DOCUMENTS 5,563,501 * 10/1996 Chan ..... 323/282
5,631,598 * 5/1997 Miranda et al. ..... 327/540

* cited by examiner

*Primary Examiner*—Jeffrey Zweizig
(74) *Attorney, Agent, or Firm*—Dwight N. Holmbo; Wade James Brady III; Frederick J. Telecky Jr.

(57) ABSTRACT

A high power supply ripple rejection internally compensated low drop-out voltage regulator using an output PMOS pass device. The voltage regulator uses an intermediate amplifier stage configured from a common source, current mirror loaded PMOS device to replace the more conventional source follower impedance buffer associated with conventional Miller compensation techniques. Compensation is achieved through use of a small internal capacitor that provides a very low frequency dominant pole at the output of the input stage while effectively pushing out the two other poles at the outputs of the second and third gain stages to a frequency well outside of the unity gain frequency to ensure closed loop stability. High, wide bandwidth PSRR is achieved through an integrated circuit implementation of three voltage gain stages compensated by a nested active Miller compensation technique that does not impedance shunt the output series PMOS pass device.

40 Claims, 1 Drawing Sheet

HIGH POWER SUPPLY RIPPLE REJECTION INTERNALLY COMPENSATED LOW DROP-OUT VOLTAGE REGULATOR USING PMOS PASS DEVICE

BACKGROUND OF THE INVENTION

1. Field of the Invention

This invention relates generally to voltage regulators, and more particularly to a low drop-out voltage regulator having internal compensation to optimize power supply rejection ripple.

2. Description of the Prior Art

Active compensating capacitive multiplier structures and techniques, e.g. nested Miller compensation, are well known in the art. The specific type of compensating circuit used is dependent upon the particular application. One application of improving phase margin for example, takes advantage of the Miller Effect by adding a Miller compensation capacitance in parallel with a gain stage, e.g., the output stage of a two stage amplifier circuit. Such a configuration results in the well-known and desirable phenomenon called pole splitting, which advantageously multiplies the effective capacitance of the physical capacitor employed in the circuit. See, e.g., for background on compensation of amplifier circuits using Miller-compensating capacitance, Paul R. Gray and Robert g. Meyer, *Analysis and Design of Analog Integrated Circuits,* Third Ed., John Wiley & sons, Inc. New York, 1993, Ch. 9, especially pp. 607–623.

Recent trends associated with high efficiency battery powered equipment are creating increased demand for power management systems using DC/DC converters feeding low drop-out (LDO) voltage regulators. Applications requiring power from such LDO voltage regulators are becoming more sensitive to noise as application bandwidth requirements are pushed ever upward. This places far greater importance on the power supply ripple rejection (PSRR) characteristics associated with LDO voltage regulators since LDO voltage regulators are used to both clean up the output noise of the DC/DC converter and to provide power supply cross talk immunity from application blocks sharing the same raw DC supply.

There is also a trend showing an increased use of ceramic capacitors as output decoupling capacitors as contrasted with the once more typical use of tantalum capacitors in such applications. The significantly low equivalent series resistance (ESR) associated with ceramic capacitors however, makes reliance on ceramic output capacitor ESR characteristics no longer feasible to stabilize an LDO amplifier control loop. Thus, a need exists in the LDO amplifier art for an internal compensation technique allowing use of a wide range of output capacitor types. Such internal compensation techniques would allow the use of much smaller output capacitors and therefore provide a means for reducing both PCB real estate requirements and external component costs.

One widely popular accepted technique associated with internal compensation is known as "Pole splitting" or "Miller Compensation" such as discussed herein above. Miller compensation, however, provides an impedance shunt across the series pass device associated with LDO voltage regulators, via the compensation capacitor and Cgs. This impedance is undesirable since it causes an early roll-off in PSRR.

The conventional two-stage PMOS low drop-out voltage regulator suffers from very poor load regulation at light, or no load, conditions. This is due to the gate of the PMOS series pass being driven from a source follower, Vdsat+Vgs, where Vt can vary from +0.2 to −0.2 V for a natural NMOS device and +0.5 to +0.9 V for a standard device. Such variations will ultimately force the first stage amplifier output devices to enter their triode region (linear mode) when the regulator is lightly loaded, resulting in a significant reduction in loop gain and hence deterioration in regulator performance.

In view of the foregoing, a need exists for an amplifier circuit architecture and technique capable of achieving higher PSRR performance from an internally compensated PMOS low drop-out voltage regulator than that presently achievable using conventional "Miller" or "Pole-splitting" techniques generally known in the art.

SUMMARY OF THE INVENTION

The present invention is directed to a circuit architecture and technique for achieving high power supply ripple rejection (PSRR) from an internally compensated PMOS low drop-out voltage regulator. This high power supply ripple rejection is achieved via a technique that provides a means for extending the PSRR outside of the usual constraints and thus enables high bandwidth PSRR characteristics from a low quiescent-current regulator. The present circuit further provides precise control of a PMOS output series pass device during light/no-load conditions without significant loss of loop gain and thereby provides highly improved no-load regulation.

A conventional PMOS low drop-out voltage regulator is generally comprised of two gain stages in order to promote simplification of any related compensated closed loop system. The input stage of such a voltage regulator is formulated via a differential amplifier. The output stage comprises a series pass PMOS device. These two stages are generally coupled together via an impedance buffer, typically a source follower, to enable the input stage high impedance output to drive the large gate capacitance of the series pass PMOS device and thereby minimize the effect of an internal pole that would otherwise interfere with loop compensation. Miller capacitor multiplication, or "Pole-splitting", is generally used by those skilled in the art to internally compensate the voltage regulator for use with ceramic output capacitors where the circuit designer cannot rely on an external compensating zero formed by the ESR associated with an electrolytic capacitor. The impedance shunt formed through the Miller compensation capacitor and PMOS Cgs using this approach however, generates a PSRR that rolls off earlier than that associated with the open loop control performance of the regulator. Further, Miller compensation yields disadvantageous no-load regulation since the input stage amplifier output is forced into its linear mode as it tries to keep the output PMOS device in deep sub-threshold/cut-off at very light or no-load conditions. This condition dramatically reduces the voltage gain of the control loop causing degradation in regulator performance.

In view of the foregoing, the present invention provides a structure and technique capable of extending the control bandwidth along with the consequential increase in quiescent current generally associated with Miller compensation and other like compensation approaches, to achieve high PSSR performance from an internally compensated PMOS low drop-out voltage regulator.

A preferred embodiment of the present invention comprises a third amplifier stage configured as a common source, current mirror loaded PMOS device, connected between the input stage differential amplifier and the output PMOS device. This third amplifier stage then replaces the more conventional source follower impedance buffer associated with the above described Miller compensation techniques. Compensation is achieved through use of a small internal capacitor that provides a very low frequency dominant pole at the output of the input amplifier stage while effectively pushing out the two other poles at the outputs of the second and third gain stages to a frequency well outside of the unity gain frequency to ensure closed loop stability.

A feature of the present invention is associated with high, wide bandwidth PSRR achieved through an integrated circuit implementation of three voltage gain stages compensated by a nested active Miller compensation technique that does not impedance shunt the PMOS series pass device.

Another feature of the present invention is associated with a PMOS common source amplifier gate drive circuit that substantially eliminates poor DC load regulation generally identified with conventional source follower drivers.

Yet another feature of the present invention is associated with a flexible internally compensated PMOS low drop-out voltage regulator capable of functioning with a wide range of output capacitors.

Still another feature of the present invention is associated with an internally compensated PMOS low drop-out voltage regulator having reduced real estate requirements relating to PCB area, die area and the like.

BRIEF DESCRIPTION OF THE DRAWINGS

Other aspects and features of the present invention and many of the attendant advantages of the present invention will be readily appreciated as the same become better understood by reference to the following detailed description when considered in connection with the accompanying drawings in which like reference numerals designate like parts throughout the figures thereof and wherein.

While the above-identified drawing figures set forth alternative embodiments, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENTS

Figure 1:
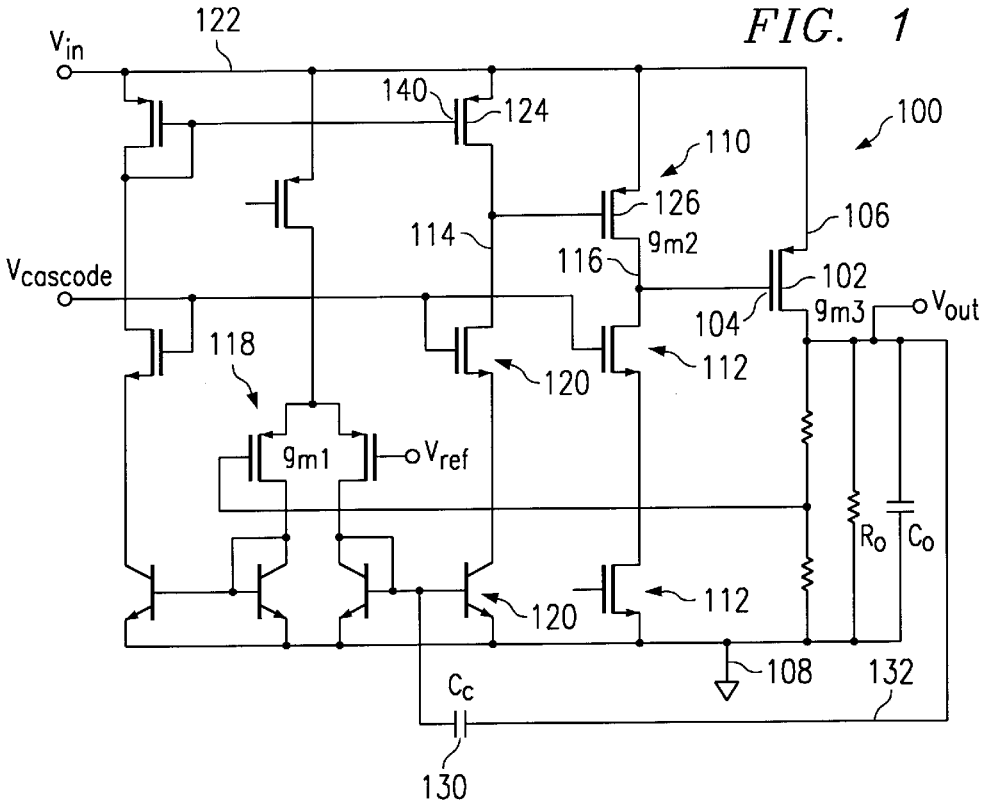
FIG. 1 illustrates a high PSRR internally compensated low drop-out voltage regulator using a PMOS pass device according to one preferred embodiment of the present invention.

FIG. 1 illustrates a high PSRR internally compensated low drop-out voltage regulator 100 using an output PMOS pass device 102 according to one preferred embodiment of the present invention. The voltage regulator 100 is capable of providing good PSRR at frequencies in the vicinity of the control loop bandwidth even though the output PMOS device 102 has its input, gate terminal 104, driven with respect to the input supply, source terminal 106 while all other driven nodes of concern regarding the control system are referenced to the voltage regulator ground 108. This high passive PSRR is achieved by ensuring the same level of ac ripple voltage appears on both the gate 104 and source 106 of the output PMOS device 102 to prevent any drain current modulation, and hence output voltage Vout ripple. The output PMOS device 102 gate 104 and source 106 terminals must therefore be configured as ac common mode.

One conventional technique to ac common mode an output PMOS device gate and source terminals uses an impedance divider where a very low impedance is presented from the supply voltage to the device gate and a very high impedance is presented from the device gate down to ground. This configuration provides a very small differential voltage to the PMOS source gate terminals.

Looking again at FIG. 1, a technique to ac common mode an output PMOS device 102 gate and source terminals according to a preferred embodiment of the present invention is seen to be achieved by using a PMOS gain stage 110 configured in common source and loaded by a high impedance cascoded current source 112. The outputs 114, 116 of the first and second gain stages 118, 110 are required to have their impedance to ground increased through cascoded devices 120, 112 respectively. Further, the first and second gain stages present a relatively low impedance to the supply rail 122 through the use of short channel devices 124, 126. The foregoing architecture serves to common mode the gate/source terminals of both the additional PMOS gain stage 110 and the output PMOS device 102. This circuit configuration will reduce the gain otherwise obtainable from the first and second stages 118, 110. The use of three gain stages instead of the more conventional two stages however, more than compensates for any such gain loss. Proper care must be taken not to reduce the aforesaid channel length associated with the upper PMOS current mirror device 124 too much, since matching performance may then be compromised and systematic errors increased.

FIG. 1 is seen to have several voltage nodes, e.g. Vin, Vcascode, Vref and Vout. The Vcascode term, as used herein, means a DC voltage bias supplied to all the cascoded transistors. The Vin term, as used herein, means the input power supply to the low drop-out voltage regulator 100. The Vref term, as used herein, means a voltage reference used by the low drop-out voltage regulator 100 to set the output voltage regulation level. Vref must have good PSRR to enable overall regulator 100 PSRR. The regulator 100 PSRR can only be as good as that of the voltage reference Vref. The Vout term, as used herein, means the regulated output voltage supply of the low drop-out voltage regulator 100.

A most significant feature of the circuit architecture shown in FIG. 1 is the achievement of desired compensation through a "uni-directional Miller multiplied capacitor" 130. The familiar and well known impedance shunt path through a compensation capacitor and Cgs of an output PMOS device associated with the feed-forward path of a conventional Miller compensation capacitor from PMOS gate to drain of the output device can be seen now to be eliminated. The unidirectional (feedback only) path 132 is provided by "Active Miller Multiplied Capacitance" such as disclosed in U.S. patent application Ser. No. 09/167,506 entitled Active Compensating Capacitive Multiplier, filed on Oct. 6, 1998 by Gabriel A. Rincon-Mora, assigned to the assignee of the present invention, and incorporated by reference in its entirety herein. A displacement current associated with the compensating capacitor 130 is sensed and fed into the current mirror 120 that produces an effective compensating capacitance at the output 114 of the input amplifier stage 118. Any perturbation on the output PMOS gate 104 cannot be fed forward through the compensation capacitor 130 as in the conventional case using Miller compensation techniques (hence the term "uni-directional Miller compensation"). A significant advantage of the present invention is that the current capacitor 130 is sensed and fed back thereby making the associated current mirror ratio capable of boosting the effective multiplied capacitor still further over the more typical Miller compensation scheme. The circuit architecture illustrated in FIG. 1 was found suitable for implementing a 120 mA voltage regulator using a 60 dB gain input stage, a 30 dB gain second stage and about a 25 dB gain output PMOS stage to provide the desired results.

Figure 2:
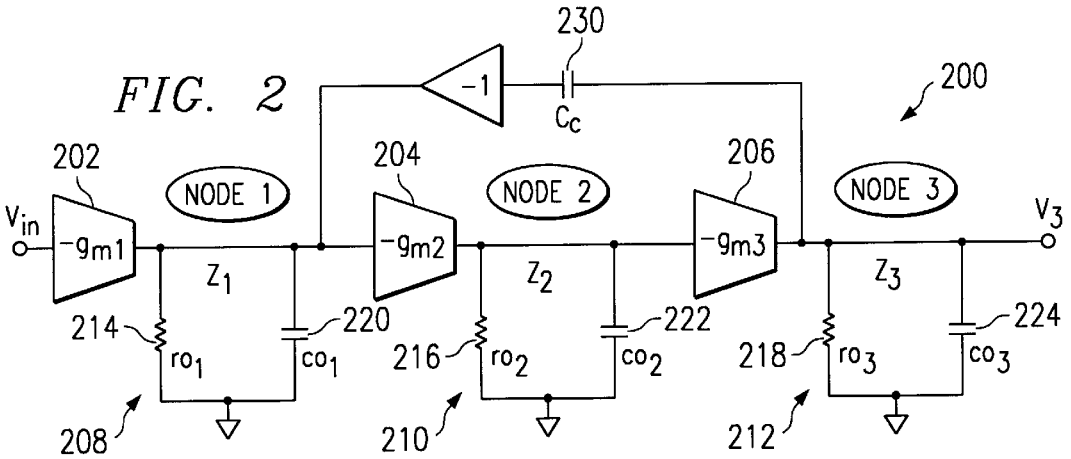
FIG. 2 is a simplified block diagram representation of the voltage regulator shown in FIG. 1.

FIG. 2 is a simplified block diagram representation of the voltage regulator 100 shown in FIG. 1 and is presented herein below in detail along with FIG. 3, to further explain functional details associated with the present invention. The system 200 depicted in FIG. 2 is comprised of three transconductance amplifiers $g_{m1}$ 202, $g_{m2}$ 204 and $g_{m3}$ 206. Each transconductance stage 202, 204, 206 drives an output impedance $Z_1$ 208, $Z_2$ 210 and $Z_3$ 212 respectively. Further, each output impedance 208, 210, 212 is comprised of output resistance $ro_1$ 214, $ro_2$ 216 and $ro_3$ 218 respectively, each in parallel with their respective output capacitances $co_1$ 220, $co_2$ 222 and $co_3$ 224. Transconductance 206 represents that of the output PMOS series pass device 102, while transconductance 204 represents the transconductance of the $2^{nd}$ stage amplifier 110 and transconductance 206 represents that of the differential pair input amplifier stage 118, where:

$$Ro=(V_A R_L)/(R_L I_D+V_A); \quad (1)$$

$co_3$=output capacitance of voltage regulator 100;

$R_L$=Load Resistance;

$I_D$=Load Current; and $V_A$=early voltage of output PMOS series pass device 102. The amplifier compensation scheme depicted in FIG. 2 is often referred to as "nested Miller compensation." A thorough analysis of this technique is presented by Johan H. Huijsing in IEEE Transactions of Solid State Circuits, Vol. 29, No. 12, December 1994, entitled A Programmable 1.5 V CMOS Class-AB Operational Amplifier with Hybrid Nested Miller Compensation for 120 dB and 6 MHz UGF, incorporated by reference herein.

Without compensation, capacitor $C_c$ 230 would exhibit three dominant poles:

$$P_1=1/(2\pi ro_1 co_1)\text{tm} \quad (2)$$

is the output pole of the differential amplifier input amplifier stage 118;

$$P_2=1/(2\pi ro_2 co_2) \quad (3)$$

is the output pole of the second amplifier stage 110; and $$P_3=1/(2\pi ro_3 co_3) \quad (4)$$

is the voltage regulator 100 output pole.

All three dominant poles $P_1$, $P_2$ and $P_3$ are relatively close in frequency, and hence, the system 200 is inherently unstable in a practical integrated circuit implementation of this three-stage amplifier system 200. Further, numerous other parasitic poles and zeros are associated with the system 200. These other parasitic poles and zeros can be shown to lie well outside of the intended practical unity gain frequency of about 300 kHz, and so therefore can be ignored for all intensive purposes. These other parasitic poles and zeros do however, introduce some degradation associated with phase margin. The present inventors found that a practical implementation of the three-stage amplifier system 200 requires use of bipolar devices as the current mirror 120 loading device of compensation capacitor 230 to decrease the impedance of the capacitor to ground.

Figure 3:
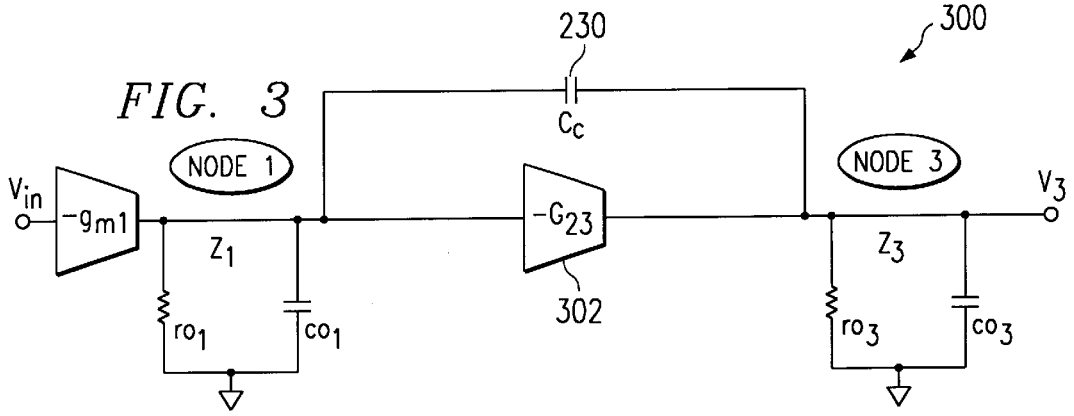
FIG. 3 is a simplified block diagram of a well known amplifier compensation scheme illustrating "nested Miller compensation".

The system 300 illustrated in FIG. 3 provides further detailed explanation on how the compensation capacitor 230 can move these three dominant poles $P_1$, $P_2$ and $P_3$ to provide a stable closed loop system 300. The two transconductances 210, 212 depicted in FIG. 2 can be regarded as one, represented by $G_{23}$ 302 in FIG. 3. Conventional Miller compensation can of course be used to push dominant poles $P_1$ to a low frequency and dominant poles $P_3$ to a high frequency, consistent with the teachings referenced herein. The present inventors have shown that the compensation capacitor 230 can be used to artfully push pole $P_2$ to high frequencies. At high frequencies, for example, compensation capacitor 230 can of course be regarded as a short circuit. Therefore, the voltage $V_1$ at node 1 can be shown as:

$$V_1 \sim V_3 = -V_2 Z_3 g_{m3}; \quad (5)$$

and therefore $$Z_2=V_2/I_2=V_2/-V_1 g_{m2} \sim -1/g_{m2} g_{m3} Z_3 \quad (6)$$

The effective output impedance $Z_2$ of node 2 in FIG. 2 is multiplied by transconductance 204 and 206 and additionally modulated by the output impedance $Z_3$, which has the effect of also pushing the dominant pole $P_2$ out to high frequencies. Further analysis has shown that the compensation capacitor 230 provides a zero that also modulates the position of the dominant pole $P_2$ at low frequencies.

Pole $P_1$ then can be seen to be the dominant pole for the system 200 since both pole $P_2$ and pole $P_3$ are pushed out to a frequency above the Unity Gain Frequency, thereby affording a stable system with good phase margin.

The present invention therefore, implements a modified nested Miller compensation scheme around a three gain stage amplifier 200 in a manner that does not shunt the impedance of the output PMOS device 102 and so generates very good PSRR. In view of the foregoing, it can be seen the present invention presents a significant advancement in the art of internally compensated low drop-out voltage regulators using an output PMOS pass device. Important to the present invention is artful implementation of a "uni-directional active compensating capacitive multiplier", a scheme wherein the displacement current in the compensating capacitor 230 is sensed and multiplied by a current mirror 120 referenced to the LDO voltage regulator 100 ground, and then injected back into a cascoded mirror device that produces a much larger effective capacitance at the output 114 of the differential amplifier input stage 118. The mirroring is "uni-directional" in that any displacement in the output voltage of the input gain stage cannot provide a change in the displacement current flowing in the compensation capacitor 230, thus eliminating the feed-forward path generally associated with a conventional Miller compensation capacitor.

This invention has been described in considerable detail in order to provide those skilled in the damping circuit art with the information needed to apply the novel principles and to construct and use such specialized components as are required. In view of the foregoing descriptions, it should be apparent that the present invention represents a significant departure from the prior art in construction and operation. However, while particular embodiments of the present invention have been described herein in detail, it is to be understood that various alterations, modifications and substitutions can be made therein without departing in any way from the spirit and scope of the present invention, as defined in the claims which follow. For example, while the embodiments set forth herein illustrate particular types of transistors, the present invention could just as well be implemented using a variety of transistor types including, but not limited to, e.g. CMOS, BiCMOS, Bipolar and HBT, among others. Further, while particular embodiments of the present invention have been described herein with reference to structures and methods of current and voltage control, the present invention shall be understood to also parallel structures and methods of current and voltage control as defined in the claims.

What is claimed is:

1. A modified Miller-compensated voltage regulator comprising:

an input amplifier stage having a differential amplifier associated therewith and further having an output node and an intermediate input node;

an intermediate amplifier stage having a first common source PMOS device associated therewith and further having an input node coupled to the input amplifier stage output node and further having an output node;

an output amplifier stage having a series PMOS device associated therewith and further having an input node coupled to the intermediate amplifier stage output node and further having an output node; and a compensating capacitor coupled at one end to the output amplifier stage output node and coupled at its other end to the input amplifier input stage intermediate input node.

2. The modified Miller compensated voltage regulator according to claim 1 wherein the input amplifier stage further comprises a cascoded current mirror having an input node coupled to the input amplifier stage intermediate input node.

3. The modified Miller compensated voltage regulator according to claim 1 wherein the intermediate amplifier stage further comprises a cascoded current mirror configured to provide a high impedance between the first common source PMOS device and a common ground associated with the voltage regulator.

4. The modified Miller compensated voltage regulator according to claim 1 wherein the first common source PMOS device is a short channel device.

5. The modified Miller compensated voltage regulator according to claim 1 further comprising a second common source PMOS device configured to provide a low impedance between the input amplifier stage cascoded mirror and a supply voltage associated with the voltage regulator.

6. The modified Miller compensated voltage regulator according to claim 5 wherein the second common source PMOS device is a short channel device.

7. The modified Miller compensated voltage regulator according to claim 1 wherein the compensating capacitor is configured to push dominant poles associated with the intermediate amplifier stage and the output stage to frequencies above a unity gain frequency associated with the voltage regulator.

8. The modified Miller compensated voltage regulator according to claim 7 wherein the compensating capacitor is further configured to push a dominant pole associated with the input amplifier stage to a low frequency such that a regulated output voltage associated with the voltage regulator will be stable.

9. A modified Miller compensated voltage regulator comprising:

an input amplifier stage having an input node and an output node;

at least one intermediate amplifier stage having an input node and an output node;

an output amplifier stage having an input node and an output node; and a feedback capacitor coupled at a first end to the output amplifier stage output node and coupled at a second end to the input amplifier stage input node; wherein the input amplifier stage, the at least one intermediate amplifier stage, the output amplifier stage and the feedback capacitor are configured to prevent current flow through the feedback capacitor back to the output amplifier stage output node; and further wherein the input amplifier stage, the at least one intermediate amplifier stage, the output amplifier stage and the feedback capacitor are configured to provide a very low frequency dominant pole at the output node of the input amplifier stage and further configured to provide a high frequency dominant pole at the output node of the at least one intermediate amplifier stage and at the output node of the output amplifier stage such that the high frequency dominant poles occur at frequencies well outside a unity gain frequency associated with the voltage regulator.

10. The modified Miller compensated voltage regulator according to claim 9 wherein the input amplifier stage comprises a differential amplifier.

11. The modified Miller compensated voltage regulator according to claim 9 wherein the input amplifier stage comprises a cascoded current mirror.

12. The modified Miller compensated voltage regulator according to claim 11 wherein the input amplifier stage further comprises a short channel PMOS device configured to couple a supply voltage to the cascoded current mirror and further configured to substantially minimize an impedance path between the cascoded current mirror and the supply voltage.

13. The modified Miller compensated voltage regulator according to claim 11 wherein the feedback capacitor is referenced at both ends to a common ground associated with the voltage regulator to render an associated current mirror ratio capable of boosting an effective multiplied capacitor associated with the voltage regulator above that attainable via a typical Miller compensation scheme.

14. The modified Miller compensated voltage regulator according to claim 9 wherein the at least one intermediate amplifier stage comprises a cascoded current mirror configured to substantially maximize an impedance path between the at least one intermediate amplifier stage and a common ground associated with the voltage regulator.

15. The modified Miller compensated voltage regulator according to claim 14 wherein the at least one intermediate amplifier stage further comprises a short channel PMOS device configured to substantially minimize an impedance path between the input node of the output amplifier stage and a supply voltage associated with the voltage regulator.

16. The modified Miller compensated voltage regulator according to claim 9 wherein the output amplifier stage comprises a series PMOS device.

17. The modified Miller compensated voltage regulator according to claim 16 wherein the feedback capacitor is a tantalum capacitor.

18. The modified Miller compensated voltage regulator according to claim 9 wherein the feedback capacitor is configured as a uni-directional Miller compensation capacitor such that current is capable of flowing solely from the output amplifier stage output node back through the feedback capacitor, but incapable of flowing in a forward direction toward the output amplifier stage output node.

19. A modified Miller compensated voltage regulator comprising:

an input amplifier stage configured to receive an input reference voltage and further configured to receive a feedback current via a nested Miller compensation capacitor associated with the voltage regulator to generate a displacement current to provide an effective Miller multiplied compensating capacitance;

an intermediate amplifier stage configured to receive the feedback displacement current associated with the nested Miller compensation capacitor such that a dominant pole associated with the intermediate amplifier stage is pushed out to a frequency above a Unity Gain Frequency associated with the voltage regulator and further configured to generate an amplified displacement current signal therefrom; and an output amplifier stage configured to receive the amplified displacement current signal such that a dominant pole associated with the output amplifier stage is pushed out to a frequency above the Unity Gain Frequency thereby rendering the voltage regulator output stage capable of generating a stable regulated output voltage at frequencies in the vicinity of the control loop bandwidth associated with the voltage regulator.

20. A modified Miller compensated voltage regulator comprising.

means for generating a uni-directional feedback current comprising an output series PMOS device;

means for generating a displacement current from the uni-directional feedback current;

means for receiving the displacement current such that dominant poles associated with the voltage regulator are pushed to frequencies outside the control loop bandwidth of the voltages regulator; and means for generating output voltage signals having substantially maximized power supply ripple rejection characteristics inside the control loop bandwidth.

21. The modified Miller compensated voltage regulator according to claim 20 wherein the means for generating a uni-direction feedback current further comprises a nested Miller compensation capacitor.

22. The modified Miller compensated voltage regulator according to claim 21 wherein the nested Miller compensation capacitor is configured such that each capacitor node is referenced to a common ground associated with the voltage regulator.

23. The modified Miller compensated voltage regulator according to claim 20 wherein the means for generating a displacement current comprises a cascoded current source.

24. The modified Miller compensated voltage regulator according to claim 23 wherein the cascoded current source comprises a PMOS device and a Bipolar device.

25. The modified Miller compensated voltage regulator according to claim 23 wherein the means for generating a displacement current further comprises a short channel PMOS device in a common source configuration.

26. The modified Miller compensated voltage regulator according to claim 20 wherein the means for receiving the displacement current such that dominant poles associated with the voltage regulator are pushed to frequencies outside the control loop bandwidth of the voltage regulator comprises a cascoded current source.

27. The modified Miller compensated voltage regulator according to claim 26 wherein the means for receiving the displacement current further comprises a short channel PMOS device in a common source configuration.

28. A modified Miller compensated voltage regulator comprising:

a supply voltage node;

a bias voltage node;

an output voltage node;

a ground;

an output series PMOS device having a source, a gate and a drain, the source connected to the supply voltage node;

a first common source PMOS device having a source, a gate and a drain, the source connected to the supply voltage node, the drain connected to the output series PMOS device gate;

a first cascoded mirror having an upper drain node, a lower source node and a gate bias node, the gate bias node connected to the bias voltage node, the upper drain node connected to the output series PMOS device gate, the lower source node connected to the ground;

a second common source PMOS device having a source, a gate and a drain, the source connected to the supply voltage node, the drain connected to the first common source PMOS device gate;

a second cascoded mirror having an upper drain node, a lower base node, a lower emitter node and a gate bias node, the gate bias node connected to the bias voltage node, the upper drain node connected to the first common source PMOS device gate, the lower emitter node connected to the ground;

a differential amplifier coupled to the supply voltage node and the ground and having a reference voltage node and a current feedback node, the current feedback node connected to the second cascoded mirror lower base node; and a compensation capacitor connected at one end to the output series PMOS device drain and connected at an opposite end to the second cascoded mirror lower base node.

29. The modified Miller compensated voltage regulator according to claim 28 further comprising a third cascoded current mirror having an upper drain, a gate, a lower emitter and a lower base node, the lower base node coupled to the differential amplifier, the gate coupled to the bias voltage node.

30. The modified Miller compensated voltage regulator according to claim 29 further comprising a diode configured PMOS device having a source connected to the supply voltage node and further having a gate and drain connected to the third cascoded current mirror upper drain.

31. A modified Miller compensated voltage regulator comprising:

an input amplifier stage having an input node and an output node, a cascoded current mirror and a short channel PMOS device configured to couple a supply voltage to the cascoded current mirror and further configured to substantially minimize an impedance path between the cascoded current mirror and the supply voltage;

at least one intermediate amplifier stage having an input node and an output node;

an output amplifier stage having an input node and an output node; and a feedback capacitor coupled at a first end to the output amplifier stage output node and coupled at a second end to the input amplifier stage input node; wherein the input amplifier stage, the at least one intermediate amplifier stage, the output amplifier stage and the feedback capacitor are configured to prevent current flow through the feedback capacitor back to the output amplifier stage output node; and further wherein the input amplifier stage, the at least one intermediate amplifier stage, the output amplifier stage and the feedback capacitor are configured to provide a very low frequency dominant pole at the output node of the input amplifier stage and further configured to provide a high frequency dominant pole at the output node of the at least one intermediate amplifier stage and at the output node of the output amplifier stage such that the high frequency dominant poles occur at frequencies well outside a unity gain frequency associated with the voltage regulator.

32. The modified Miller compensated voltage regulator according to claim 31 wherein the feedback capacitor is referenced at both ends to a common ground associated with the voltage regulator to render an associated current mirror ratio capable of boosting an effective multiplied capacitor associated with the voltage regulator above that attainable via a typical Miller compensation scheme.

33. The modified Miller compensated voltage regulator according to claim 31 wherein the at least one intermediate amplifier stage comprises a cascoded current mirror configured to substantially maximize an impedance path between the at least one intermediate amplifier stage and a common ground associated with the voltage regulator.

34. The modified Miller compensated voltage regulator according to claim 33 wherein the at least one intermediate amplifier stage further comprises a short channel PMOS device configured to substantially minimize an impedance path between the input node of the output amplifier stage and a supply voltage associated with the voltage regulator.

35. The modified Miller compensated voltage regulator according to claim 31 wherein the output amplifier stage comprises a series PMOS device.

36. The modified Miller compensated voltage regulator according to claim 31 wherein the feedback capacitor is a tantalum capacitor.

37. The modified Miller compensated voltage regulator according to claim 31 wherein the feedback capacitor is configured as a uni-directional Miller compensation capacitor such that current is capable of flowing solely from the output amplifier stage output node back through the feedback capacitor, but incapable of flowing in a forward direction toward the output amplifier stage output node.

38. A modified Miller compensated voltage regulator comprising:

an input amplifier stage having an input node and an output node;

an output amplifier stage having an input node and an output node;

at least one intermediate amplifier stage having an input node and an output node, a cascoded current mirror configured to substantially maximize an impedance path between the at least one intermediate amplifier stage and a common ground associated with the voltage regulator and a short channel PMOS device configured to substantially minimize an impedance path between the input node of the output amplifier stage and a supply voltage associated with the voltage regulator; and a feedback capacitor coupled at a first end to the output amplifier stage output node and coupled at a second end to the input amplifier stage input node; wherein the input amplifier stage, the at least one intermediate amplifier stage, the output amplifier stage and the feedback capacitor are configured to prevent current flow through the feedback capacitor back to the output amplifier stage output node; and further wherein the input amplifier stage, the at least one intermediate amplifier stage, the output amplifier stage and the feedback capacitor are configured to provide a very low frequency dominant pole at the output node of the input amplifier stage and further configured to provide a high frequency dominant pole at the output node of the at least one intermediate amplifier stage and at the output node of the output amplifier stage such that the high frequency dominant poles occur at frequencies well outside a unity gain frequency associated with the voltage regulator.

39. A modified Miller compensated voltage regulator comprising:

an input amplifier stage having an input node and an output node;

at least one intermediate amplifier stage having an input node and an output node;

an output amplifier stage having an input node, an output node and a series PMOS device; and a feedback capacitor coupled at a first end to the output amplifier stage output node and coupled at a second end to the input amplifier stage input node; wherein the input amplifier stage, the at least one intermediate amplifier stage, the output amplifier stage and the feedback capacitor are configured to prevent current flow through the feedback capacitor back to the output amplifier stage output node; and further wherein the input amplifier stage, the at least one intermediate amplifier stage, the output amplifier stage and the feedback capacitor are configured to provide a very low frequency dominant pole at the output node of the input amplifier stage and further configured to provide a high frequency dominant pole at the output node of the at least one intermediate amplifier stage and at the output node of the output amplifier stage such that the high frequency dominant poles occur at frequencies well outside a unity gain frequency associated with the voltage regulator.

40. The modified Miller compensated voltage regulator according to claim 39 wherein the feedback capacitor is a tantalum capacitor.

* * * * *